US008024877B2

(12) United States Patent
Zhu

(10) Patent No.: US 8,024,877 B2
(45) Date of Patent: Sep. 27, 2011

(54) ELECTRIC FIREPLACE FLAME CURTAIN WITH FLEXIBLE SIMULATED CARBON BED

(76) Inventor: Hongfeng Zhu, Zhejiang (CN)

( * ) Notice: Subject to any disclaimer, the term of this patent is extended or adjusted under 35 U.S.C. 154(b) by 129 days.

(21) Appl. No.: 12/388,066

(22) Filed: Feb. 18, 2009

(65) Prior Publication Data

US 2010/0205840 A1 Aug. 19, 2010

(51) Int. Cl.
*G09F 19/00* (2006.01)

(52) U.S. Cl. ..... 40/428; 219/218

(58) Field of Classification Search ..... 40/428; 219/218

See application file for complete search history.

(56) References Cited

U.S. PATENT DOCUMENTS 1,692,021 A * 11/1928 Auer ..... 392/348
4,965,707 A * 10/1990 Butterfield ..... 362/96
6,269,567 B1 * 8/2001 MacPherson et al. ..... 40/428
6,944,982 B2 * 9/2005 Schroeter et al. ..... 40/428

* cited by examiner

*Primary Examiner* — Casandra Davis
(74) *Attorney, Agent, or Firm* — Global IP Services; Tianhua Gu

(57) ABSTRACT

The present invention relates to an electric fireplace flame curtain with flexible simulated charcoal bed, the flame curtain is a structure of vessel, comprises a front wall and a rear wall with transparent structure, an imaging mechanism disposed on the front wall of the vessel, a number of movable light-holding charcoals with a plurality of transparent surfaces disposed in the vessel. The essential effect of the present invention is to solve the monotone flame, dull appearance and poor visual effect of the exiting electric fireplace. Meanwhile, the problems such as constant charcoal flame brightness, lack of reality, bad simulative effect are solved as well. The present invention could simulate a plurality of independent charcoal burning spots, with various styles. The light-spots of the flame are sparkling intermittently with bright and shade, and the flame is of light-holding effect. The visual effect and the authenticity are both perfect.

9 Claims, 4 Drawing Sheets

ELECTRIC FIREPLACE FLAME CURTAIN WITH FLEXIBLE SIMULATED CARBON BED

FIELD OF THE INVENTION

The present invention relates to an electric fireplace, more particularly, an electric fireplace flame curtain with flexible simulated charcoal bed.

BACKGROUND OF THE INVENTION

Conventional fireplace simulator structures are divided into two types by the simulation of the burning substance of the fireplace. One is a simulation of burning flame by projecting varying light onto an image screen with imaging operation. Such as the flame simulator of electric fireplace disclosed in the patent with publication date Sep. 5, 2007 and publication number CN 200944291, comprises a light source, a flame board, a translucent image screen, a light shade with a transparent hole, a simulative fuel bed in front of a housing chamber. The light shade with a transparent hole is disposed at the back of the flame board, and a glass screen is fixed in front of the image screen. The light source cooperates with the light shade, and the light shade cooperates with a transmission mechanism. In the structure described above, the light shade can be disposed either horizontally or vertically to cooperate with the transmission mechanism to achieve a kind of axial and radial move of the light. The light forms the shape of flame after passing through a flame hole disposed on the flame board, and then be projected onto the image screen and the glass screen to carry out the visual effect of flame with vertical rising and horizontal waving. The other one is a simulation of burning charcoal flame in the fireplace by disposing an unchangeable structure with wood-like or charcoal-like figure besides or under the lower portion of the image screen. Such as the artificial wood for electric fireplace disclosed in the patent with publication date Apr. 7, 2004 and publication number CN 2610233, comprises an artificial wood base and a light source. The base is an irregular transparent chamber with artificial wood figure. LED tubes or light bulbs are disposed in the chamber. Each LED tubes or light bulbs are connected in series or in parallel and then lead out of the base by a conducting wire to connect with an external power source. The artificial wood base is of translucent material with pigment layers disposed irregularly on the external surface. The pigment layers can be chosen from various colors according to simulation needs, ordinarily, the dark brown similar to the wood color. The patent described above combines the artificial wood base and the light source. The light source is disposed in the artificial wood base. The base with pigment layer irregularly smeared on the external surface is made of transparent material. Thus, when the light source inside generates light, a kind of artificial burning effect with light and shade stager with each other is achieved, which is similar to the effect of burning charcoals. The structure is simple, realistic, and the figure and realism of which is closely to the natural burning flame. As to the charcoal flame simulated through the similar mode such as the wood or charcoal bed with fixed structure, the change between shade and light of the flame color achieves mainly via the pigment layers smeared irregularly on the external surface of the wood or the charcoal bed. Thus, the figure and the change between light and shade of the charcoal flame of each fireplace are constant and do not change. Thereby, the uniform external figure of the charcoal flame affects the visual effect. In addition, the brightness of the fireplace charcoal flame does not change either. The lack of intermittent light and shade of the spark light-spot and the realism make the simulation effect affected.

SUMMARY OF THE INVENTION

To solve the problems such as the constant brightness of charcoal flame, dull appearance and poor visual effect and etc. . . . . The present invention provides an electric fireplace flame curtain. The main object of the present invention is to provide an electric fireplace flame curtain varying charcoal flame structure and excellent visual effect.

Another object of the present invention is to provide a electric fireplace flame curtain with phantasmagoric and permanent flame image around the burning spots or among the charcoal when the charcoal is burning like real flame burning permanently around the charcoal or among the charcoal, sparkling light-spots of the charcoals with intermittent light and shade, good reality and simulation effect, and solve the problems such as the existing technology such as the fixed figure of charcoal flame, lack of reality, bad simulation effect and so on.

According to one exemplary embodiment, the present invention relates to an electric fireplace flame curtain with flexible simulated charcoal bed, the electric fireplace flame curtain is of a structure of vessel, comprised a front wall and a rear wall with transparent structure, an imaging mechanism disposed on the front wall of the vessel, a number of movable light-holding charcoals with a plurality of transparent surfaces disposed in the vessel. The flame curtain is a kind of structure of vessel, an image mechanism is disposed on the front wall of the vessel, and a number of light-holding charcoals with a plurality of transparent surfaces are disposed in the vessel, such a structure replaces the wood or charcoal bed with integral structure of the conventional electric fireplace. Because of the relative positioning function of the vessel, the light-holding charcoals of various sizes and shapes in the vessel can change the stacking position in the vessel arbitrarily to form a charcoal bed structure of various shapes. Users can customize the figure of the charcoal bed according to personal visual preference to satisfy the visual requirement of every kind, at the same time. The visual effect of the electric fireplace is improved. The transparent surface on the light-holding charcoal refers to a certain surface of the light-holding charcoal, which is photic, then refracts and reflects the light passing through, and simultaneously reflects external light, so the light is refracted and reflected inside the light-holding charcoal, among the light-holding charcoal, as well as between the light-holding charcoal and the image screen for several times, and a light-holding effect is achieved. In addition, the shape and size of the light-holding charcoal, the number and transparent property of transparent surfaces can be chosen according to personal preference. A plurality of light-tight surfaces could be disposed on the light-holding charcoals as well. Moreover, the number of light-holding charcoals can be increased or decreased according to personal preference of user, and generally the height of the charcoals is lower than half the height of the front wall of the vessel, in order to reserve enough flame space and charcoal adjusting space for the vessel. The front and rear walls of transparent structure ensure that the imaging light of the electric fireplace passes through the vessel and forms a kind of flame picture on the image screen.

Preferably, the vessel is of flat box structure disposed vertically, said imaging mechanism is a thin image screen attached to the front wall of the vessel, or a mat surface structure or an image film disposed on the front wall of the vessel, the image screen, or the mat surface structure or the image film is disposed on the back side of the front wall, the area of the image screen, or the mat surface structure or the image film is smaller than or equal to the area of the front wall. The vessel is designed to be of a flat box structure and the width and height of the vessel matches the size of image screen of the electric fireplace, so the front wall of vessel could be used as the imaging mechanism of the electric fireplace, and the structure of electric fireplace is simplified. The fore-and-aft (in the direction from the front to the back of the electric fireplace) thickness of vessel is relatively low, which adapts to the structure of electric fireplace with large width and height but low thickness, and ensures enough light passing though the vessel and adequate brightness at the image screen in front of the vessel. The imaging mechanism could be a thin image screen attached to the front wall of vessel, or a mat surface structure disposed directly on the front wall of the vessel, or an image film coated or attached to the front wall of vessel, the three possible structure described above are all existing technology. The image screen, the mat structure and the image film are preferably disposed on the inner side of the front wall of vessel, and the external side of the front wall of vessel is also tolerable. In case of the front wall of the vessel is thin or a thin image screen is used directly as the front wall of the vessel, the mat structure or image film structure can be disposed at both the inner and external side of the front wall.

Preferably, the light-holding charcoals are of polyhedron with numerous refracting surfaces, the polyhedron is made of homogeneous transparent material, a charcoal flame bright section is formed at where the light-holding charcoals are close to the image screen or the front wall of the vessel, a wedge gap around the charcoal flame bright section is a light-holding section. The refracting surfaces could be of flat, arc or other kinds of curve structure. The polyhedron light-holding charcoal with numerous refracting surfaces has the functions of refraction and reflection. Under the projection of irregular light from the electric fireplace flame generator, the refraction effect of the light-holding charcoal makes the light of a certain period and a certain angle focus on the imaging screen. Viewing from the image screen, the surface of the light-holding charcoal disposed close to the front wall of the vessel or the imaging screen forms a charcoal flame bright section which is similar to the sparkling light-spots of burning charcoal. The light from the flame generator is intermittent, so the sparkling light-spots are intermittently bright and shade, which is very similar to the burning and lighting circumstance of real charcoal, and with strong reality. Besides, some varying light feels like being held in the charcoal bed after numbers of refraction and reflection by the light-holding charcoal, and some varying light project directly onto the image screen, some light reflect several times by the surface of the light-holding charcoal, that is to say numerous reflections in the wedge gap, and superposition of several lights, together with the remained visual and the image combination function of individual brain, the a light-holding section is formed in the wedge gap around the charcoal flame bright section which makes people feel like that the flame stays near the gap space of the charcoals and burns with a rolling and phantasmagoric configuration, further improves the reality of the charcoal bed and the visual aesthetic feeling of the electric fireplace. The light-holding charcoals can also be of a translucent structure. As the transparent effect of the translucent structure is relatively worse, the light transmittance of the charcoal bed is lower, and the brightness of sparkling light-spots and the light-holding section is of lower. However, the simulative charcoal flame of the charcoal bed has a haze feeling and thus another kind of prospect.

Preferably, a plurality of simulative charcoals with natural charcoal shape are disposed in said vessel, the simulative charcoals are of transparent or translucent and made of homogeneous material. By interlarding optimum amount of simulative charcoals with transparent or translucent structure in the light-holding charcoals, the charcoal bed structure is more close to the real charcoal flame. The shape of the charcoal could be of nubbly structure or stick or stick structure with branch. As to the simulative charcoals with transparent and translucent structure, the simulative charcoal with translucent structure is preferred because the relatively weak light transmit capability of the simulative charcoal with translucent structure makes the imaging screen looks darker thereon and some charcoals among the charcoal bed appears to be of burning less intensely. At the same time, the brightness of the outline of simulative charcoals with translucent structure under the projection of the light from the electric fireplace flame generator and the refracting and reflecting light from the light-holding charcoal with polyhedron structure is obviously greater than the brightness of the central portion of charcoals, which accords with the structure characteristics of charcoals at early stage of burning, and thus the simulation effect of the charcoal is obviously enhanced. Normally, the proportion of the light-holding charcoals and the simulative charcoals is from 2:1 to 8:1.

Preferably, the front wall and rear wall of said vessel are of flat or curved surface structure, the width of the rear wall matches the width of the front wall, the height of the rear wall is lower than or equal to the height of the front wall, a base plate of vessel is of transparent or translucent structure. As the front wall of the vessel also works as the imaging screen of the electric fireplace, the front wall of the vessel or the transparent plate with flat or curved structure conforms to general requirements of the electric fireplace imaging screen structure. The rear wall structure of the vessel is preferred to be of the same structure with that of the front wall. Thereby, the whole vessel is of a kind of structure with constant thickness, which avoids the regional brightness variation of the imaging screen brought by the variation of the thickness of vessel. If such variation is considered on the design process, a vessel structure with thinner central portion and both thick side portions could be taken into account to conform to structure characteristics of normal burning substance with higher luminance at the center portion of burning and lower luminance at the side portion. Moreover, the height of the rear wall of the vessel is preferred to be of the same as that of the front wall, though the height of the light-holding charcoals disposed in the vessel usually does not approach to the top of the front wall of the vessel. If the height of the rear wall is decreased for the saving of material, the upper edge of the rear wall of the vessel may appear on the imaging screen under the projection of light from the flame generator and thus influences the realism of the flame simulation of the electric fireplace and the visual effect. Irregular edges at upper end of the rear wall of the vessel can compensate this shortcoming described above at a certain extent. As the vessel has a certain thickness, when a user sights from above to below, the charcoal flame should be observed at the bottom of the vessel. Thus, the bottom plate of the vessel is preferred to be transparent or translucent. By the projection of the imaging light source at the bottom of the fireplace, the charcoal at the bottom of the vessel appears to be of bright structure according to the structure characteristic of real charcoal flame.

The flame curtain is disposed in front of an electric fireplace flame generator, the flame generator includes a rotating axis driven by electric machinery and reflecting strips disposed on the rotating axis, or the flame generator is of axis sleeve type including central axis, rotating sleeve and reflecting strips disposed on the rotating sleeve. The flame curtain of the present invention is disposed on the front of the flame generator of electric fireplace. The front wall of the vessel disposed on the flame curtain is on the same position with the traditional image screen of electric fireplace. The base plate of the vessel is on the same position with the traditional charcoal bed of electric fireplace. Both the flame generator structures preferably described above are technically available. Others available flame generator structures could also be acceptable in the present invention application.

As a metamorphic exemplary embodiment of the present invention, the bottom of the front wall is protrusive to be L-shaped portion and form a concave groove inside, said concave groove has a trapezoid cross-section. The bottom structure of the charcoal flame is improved and the structure of charcoal flame is more three-dimensional, so is the felling of the charcoal flame. The concave groove with trapezoid cross-section makes the transition of upper and lower charcoal flame more nature and close to the nature configuration of real charcoal flame.

Another structure is achieved if disposing the concave groove of the embodiment described above separately: a chamber is disposed at the forward bottom of the vessel, the light-holding charcoals are disposed in the chamber, and a cover with imaging mechanism disposed inside is mounted at the top of the chamber, said chamber is of trapezoid cross-section or rectangular structure. The chamber and vessel are disposed separately and the effect is almost the same with the embodiment described above. Not only the light-holding charcoals but also the simulative charcoals with natural shape are disposed in the chamber.

In the two embodiments described above, the base plate of the vessel or chamber is transparent or translucent. When the transparent or translucent base plate is under the projection of the imaging light source disposed at the bottom of the fireplace, the charcoals at the bottom of the vessel appears to be of bright structure, which conforms to the structure characteristics of real burning charcoal flame.

In the two metamorphic embodiments described above, preferably, a flame generator is disposed at the bottom portion of the vessel or the chamber, the flame generator includes a rotating axis driven by electric machinery and reflecting strips disposed on the rotating axis, or the flame generator is of axis sleeve type including central axis, rotating sleeve and reflecting strips disposed on the rotating sleeve. The concave groove or the chamber disposed at the bottom of the vessel is basically transverse. Light from the back of the vessel is difficult to form a well simulative image on the inclined bottom image screen. Thus, a flame generator is particularly disposed at the bottom portion of the vessel or the chamber, hereby the imaging light simulating the sparkling light-spot of the charcoal flame appears on the imaging mechanism at the bottom of the front wall of the vessel or the chamber, the realism of the charcoal flame is increased.

The essential effect of the present invention is to solve the monotone flame, dull appearance and poor visual effect of the exiting electric fireplace, meanwhile, the problems such as constant charcoal flame brightness, lack of reality, bad simulative effect are solved as well. The present invention could simulate a plurality of independent charcoal burning spots, with various styles. The light-spots of the flame are sparkling intermittently with bright and shade, and the flame is of light-holding effect. The visual effect and the authenticity are both perfect.

DETAILED DESCRIPTION OF THE INVENTION

Through the embodiments described subsequently and the drawings combined with, the technique detailed of the present invention could be fully understood.

Preferred Embodiment 1

Figure 1:
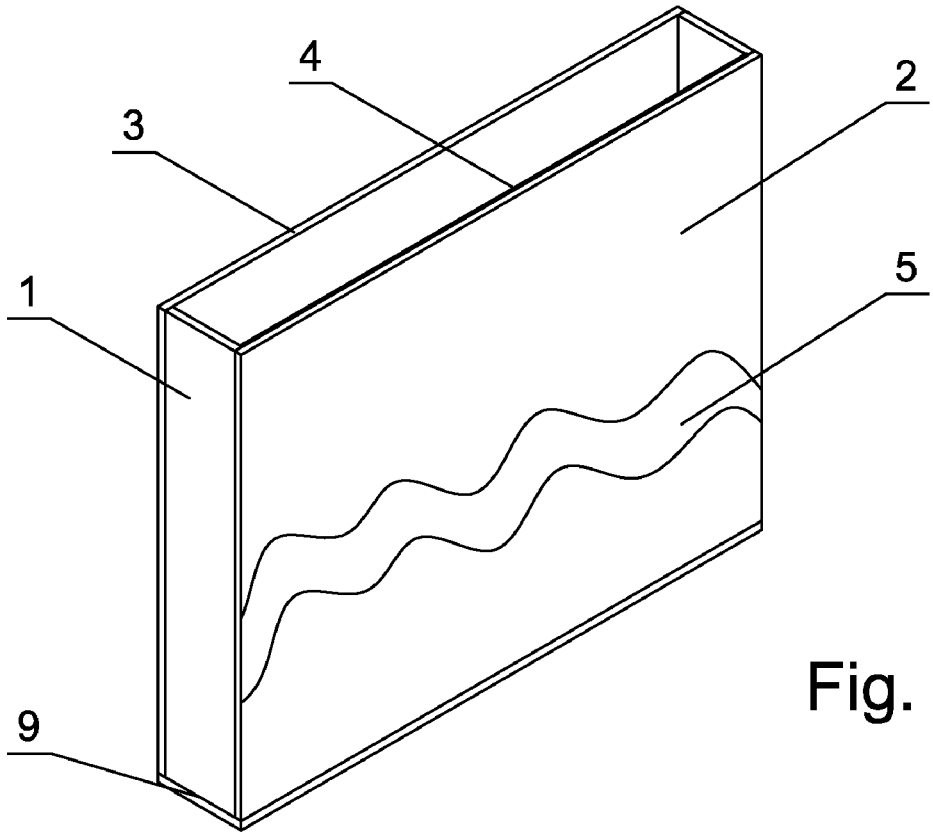
FIG. 1 shows the first embodiment of the electric fireplace flame curtain with flexible simulated charcoal bed according to the present invention.
Figure 5:
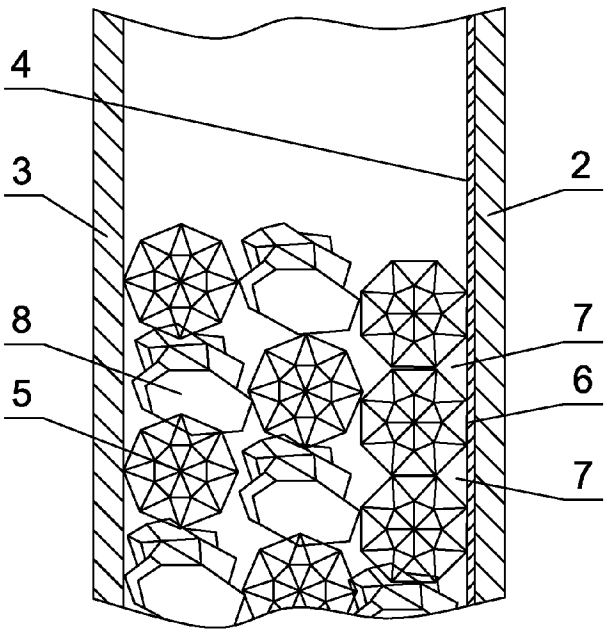
FIG. 5 shows a partial view of the electric fireplace flame curtain with flexible simulated charcoal bed.
Figure 6:
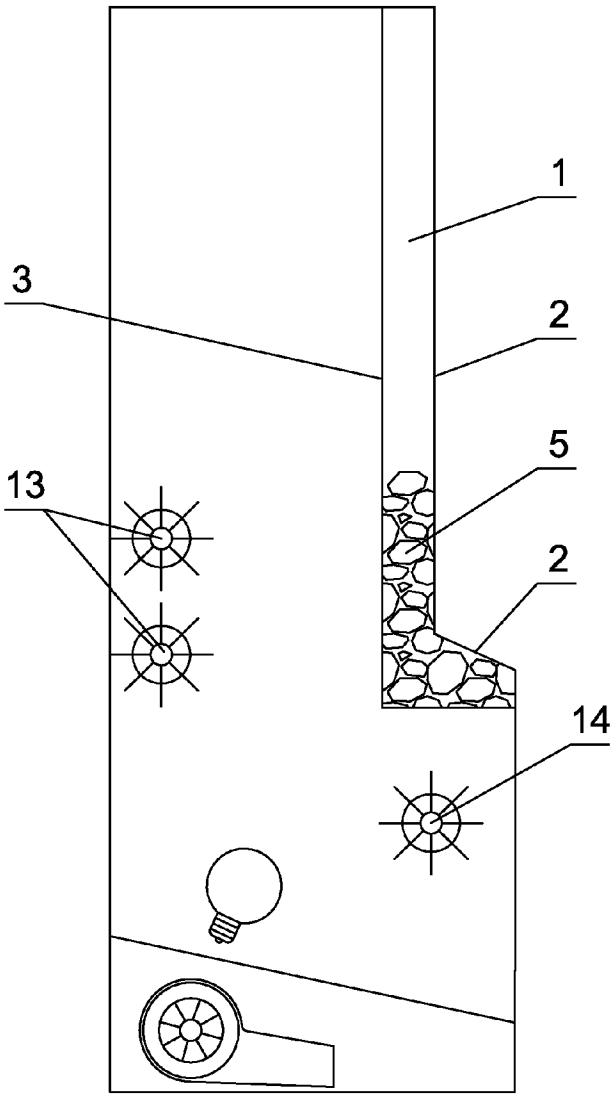
FIG. 6 shows an electric fireplace with the flame curtain of present invention.

As shown in FIG. 1, an electric fireplace flame curtain with flexible simulated charcoal bed, the flame curtain is of a structure of vessel 1, the vessel 1 is of flat box structure disposed vertically, comprises a front wall 2 and a rear wall 3 made of transparent flat glass, the thickness and height of the front wall and the rear wall are same; an imaging mechanism 4 disposed on the front wall 2 of the vessel 1, the imaging mechanism 4 is a thin image screen attached to inner side of the front wall 2, the size of the image screen is smaller than or equal to the size of the inner side of the front wall; a number of movable light-holding charcoals 5 with a plurality of refraction surfaces and a plurality of simulative translucent charcoals 8 with natural charcoal shape disposed in the vessel 1, a proportion of the light-holding charcoals 5 and the simulative charcoals 8 is 4:1, the refraction surface of the light-holding charcoal is of flat structure, the polyhedron is made of homogeneous material. A charcoal flame bright section 6 is formed at where the light-holding charcoals 5 are close to the image screen, a wedge gap around the charcoal flame bright section is a light-holding section 7 (as shown in FIG. 5). The base plate 9 of the vessel 1 is transparent glass.

The flame curtain is disposed in front of an electric fireplace flame generator 13, the flame generator includes a rotating axis driven by electric machinery and reflecting strips disposed on the rotating axis.

Preferred Embodiment 2

Figure 2:
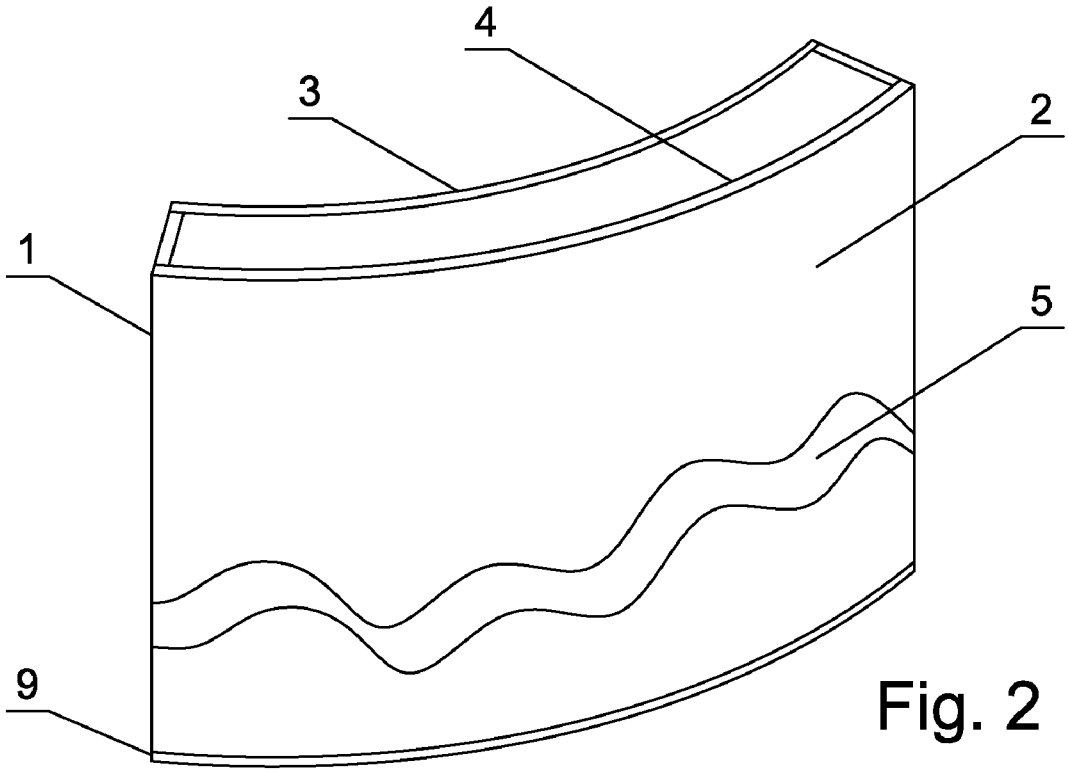
FIG. 2 shows the second embodiment of the electric fireplace flame curtain with flexible simulated charcoal bed according to the present invention.

As shown in FIG. 2, the flame curtain is a flat box vessel disposed vertically. The width and height of the front wall and the rear wall of the vessel are same and both are of curved structure protruding forward. The front wall 2 of vessel 1 is red translucent glass. The rear well is transparent glass. An imaging mechanism 4 is disposed on the front wall 2 of vessel 1, and the imaging mechanism is of a mat frosting structure disposed at the inner side of the front wall. The size of mat frosting structure is equal to the inner side of the front wall. A number of movable light-holding charcoals 5 with a plurality of refraction surfaces and a plurality of simulative translucent charcoals 8 with natural charcoal shape are disposed in the vessel 1, a proportion of the light-holding charcoals and the simulative charcoals is 6:1. The base plate 9 of the vessel 1 is translucent glass. The other structures of the flame curtain are the same as that described in the first preferred embodiment.

The flame curtain is disposed in front of an electric fireplace flame generator, the flame generator is of axis sleeve type including central axis, rotating sleeve and reflecting strips disposed on the rotating sleeve.

Preferred Embodiment 3

Figure 3:
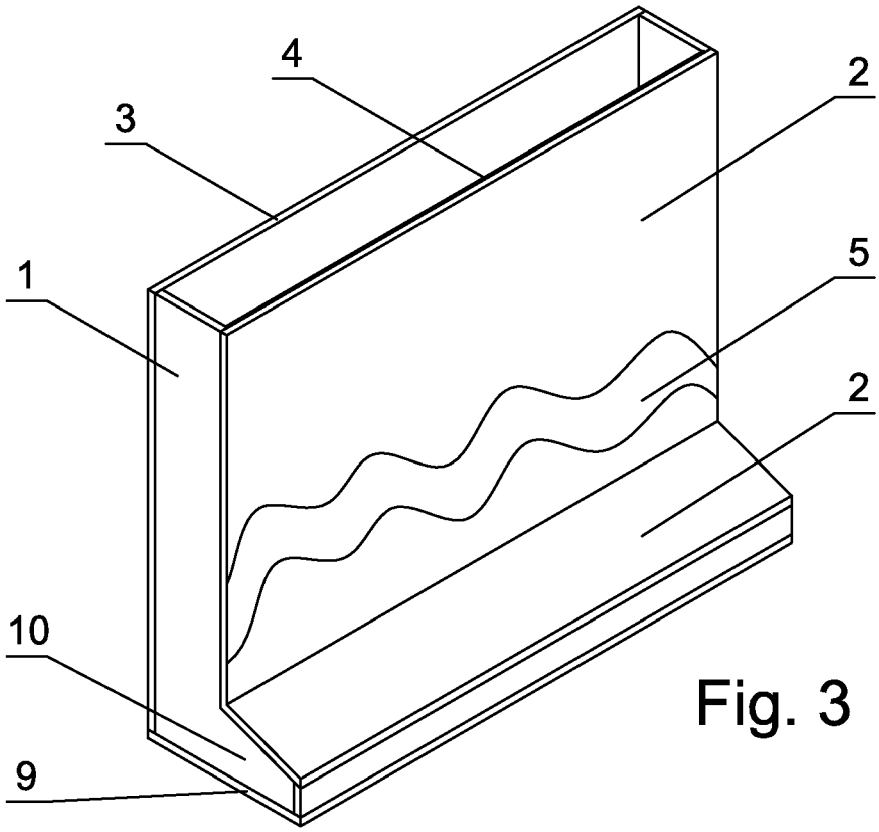
FIG. 3 shows the third embodiment of the electric fireplace flame curtain with flexible simulated charcoal bed according to the present invention.

As shown in FIG. 3, the bottom of the front wall 2 is protrusive to be L-shaped portion and form a concave groove 10 inside, said concave groove 10 has a trapezoid cross-section. An imaging mechanism 4 is disposed on the front wall 2 of the vessel 1, the imaging mechanism 4 is a red imaging film disposed at the inner side of front wall. The size of the imaging film is the same with the size of the inner side of the front wall. A proportion of the light-holding charcoals and the simulative charcoals is 8:1. The other structures of the flame curtain are the same as that described in the first preferred embodiment.

The flame curtain is disposed in front of an electric fireplace flame generator 13. Another flame generator is disposed at the bottom portion of the vessel. The flame generator includes a rotating axis driven by electric machinery and reflecting strips disposed on the rotating axis.

Preferred Embodiment 4

Figure 4:
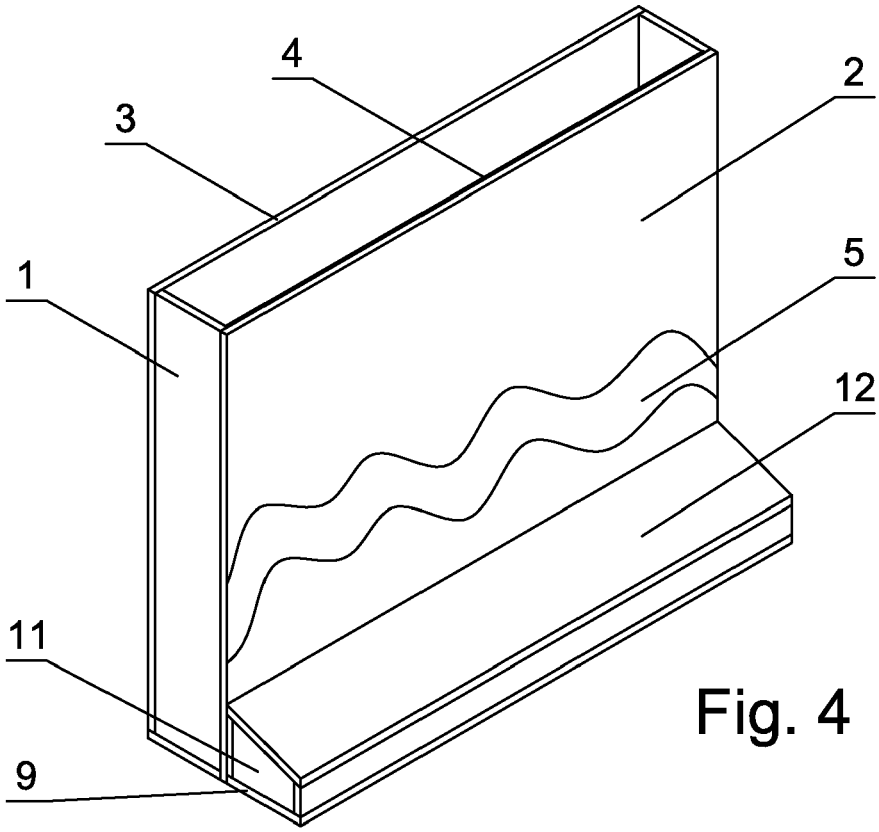
FIG. 4 shows the forth embodiment of the electric fireplace flame curtain with flexible simulated charcoal bed according to the present invention.

As shown in FIG. 4, a chamber 11 is disposed independently at the forward bottom of the vessel 1, the light-holding charcoals 5 and simulative charcoals with nature charcoal shape are disposed in the chamber 11. A proportion of the light-holding charcoals and the simulative charcoals is 2:1. The chamber 11 is of trapezoid cross-section or rectangular structure. A cover 12 with imaging mechanism disposed inside is mounted at the top of the chamber 11. The imaging mechanism is a thin image screen attached to the inner side of the cover 12. The base plate 9 of the chamber 11 is of transparent structure. The structure of vessel 1 is the same as the structure described in the first embodiment.

The flame curtain is disposed in front of an electric fireplace flame generator 13. Another flame generator is disposed at the bottom portion of the chamber. The flame generator is of axis sleeve type including central axis, rotating sleeve and reflecting strips disposed on the rotating sleeve.

Figure 7:
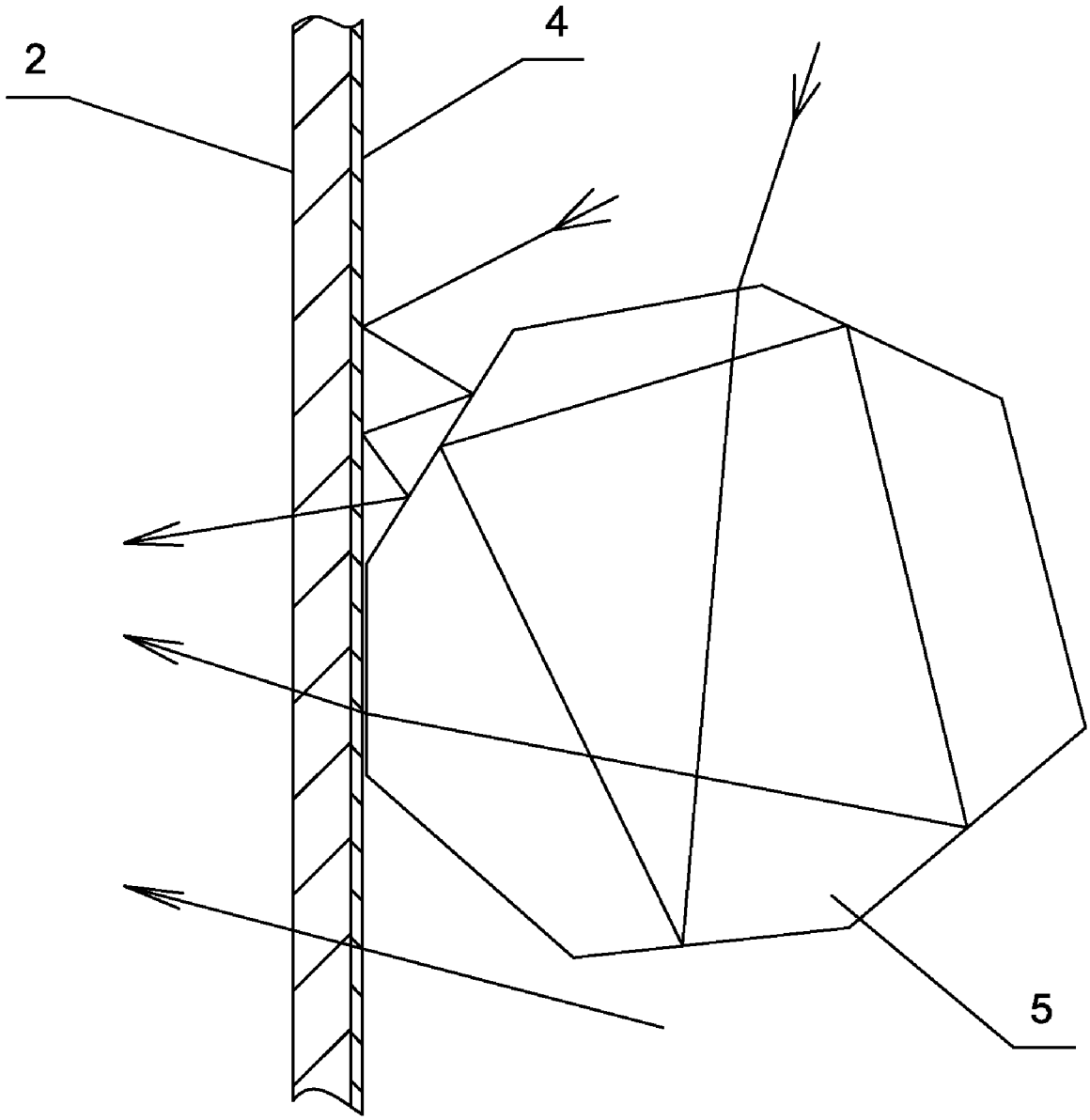
FIG. 7 shows the illustrative view of the light near the light-holding charcoals of the electric fireplace flame curtain with flexible simulated charcoal bed of present invention.

When the electric fireplace with a flame curtain is in use, the flame curtain is disposed in front of the electric fireplace flame generator. The light source of the electric fireplace is reflected to the flame curtain through the flame generator. Image shown at the higher portion of the flame curtain without charcoals disposed beside is basically the same as imaging effect produces by conventional technique. Flame image of burning is formed under the projection of the jumping imaging light. When the light is project to the light-holding charcoals at the lower portion of the flame curtain, light at a certain period and with a certain angle focuses on the image screen. Viewing on the image screen, a charcoal bright section is formed where the light-holding charcoals are close to the front wall of the vessel or the image screen, the charcoal bright section is very familiar to sparkling light-sports or burning area of burning charcoals and it is perfectly living. Because the light from the flame generator is intermittent, the sparkling light-spots or the burning section are intermittently bright and shade, which is very similar to burning and lighting circumstance of real charcoal. Besides, some varying light feels like being held in the charcoal bed after numbers of refraction and reflection by the light-holding charcoal, meanwhile, some light project directly onto the image screen, some light reflect several times by the surface of the light-holding charcoal, that is to say numerous reflections in the wedge gap, and superposition of several lights, together with the remained visual and the image combination function of individual brain, the a light-holding section is formed in the wedge gap around the charcoal flame bright section which makes people feel like that the flame stays near the gap space of the charcoals and burns with a rolling and phantasmagoric configuration, further improves the reality of the charcoal bed and the visual aesthetic feeling of the electric fireplace (as shown in FIG. 7). As to the simulative charcoals with translucent structure disposed in the vessel, they are less pervious to light and thus look darker on the image screen, and thereby some charcoals with less burning level appear in the charcoal bed. Under the projection of the light from the electric fireplace flame generator and the refracting and reflecting light from the light-holding charcoals with polyhedron structure, the brightness at the outline of the charcoal is greater than the brightness at the center of the charcoal. Such structure conforms to the structure characteristics when charcoals or wood start burning, and thus the simulation effect of the charcoal is obviously improved.

As to the structure of the concave groove or chamber disposed at the bottom of the flame curtain, the projecting light to the concave groove or the chamber mainly depends on the flame generator disposed at the bottom portion of the flame curtain. The flame effect is quite the same as the main embodiment, but, they bottom structure of the charcoal flame is improved, the flame structure is more three-dimensional, and the three-dimensional feeling of the charcoal flame is improved a lot. The transition of charcoals disposed upper and lower is nature and feels like the nature configuration of charcoal flame.

When the shape of charcoal bed needs to be change, the only thing one need to do is to open the cover plate of the electric fireplace and stir, add or remove the charcoals disposed in, or change the proportion of various charcoals to reshape the shape of the charcoal bed. Not only the shapes of charcoals bed is changed, the light path of refraction and reflection inside the charcoal bed the flame bright section and the light-holding section also changes. Therefore, a brand new appearance presents leads to a completely different visual effect.

What is claimed is:

1. An electric fireplace flame curtain with adjustable simulated charcoal bed comprising:

a flat vessel having a transparent front wall and a transparent rear wall;

an imaging mechanism attached on a backside of the front wall, said imaging mechanism is a thin image screen or a mat surface structure or an image film;

a plurality of light-holding charcoals with a plurality of transparent surfaces stacked in the vessel;

an electric fireplace flame generator fixed behind the flat vessel, which includes a rotating axis driven by electric machinery and reflecting strips disposed on the rotating axis;

a charcoal flame bright section is formed at where the light-holding charcoals touch or close to the image mechanism, a wedge gap around the charcoal flame bright section is a light-holding section.

2. The electric fireplace flame curtain with adjustable simulated charcoal bed as claimed in claim 1, wherein each said light-holding charcoals is of polyhedron with numerous refracting surfaces, the polyhedron is made of homogeneous transparent material.

3. The electric fireplace flame curtain with adjustable simulated charcoal bed as claimed in claim 1, wherein a plurality of simulative charcoals with natural charcoal shape are mixed with the light-holding charcoals in said vessel, the simulative charcoals are of transparent or translucent and made of homogeneous material.

4. The electric fireplace flame curtain with adjustable simulated charcoal bed as claimed in claim 1, wherein the front wall and rear wall of said vessel are of flat surface structure, the width of the rear wall matches the width of the front wall, the height of the rear wall is lower than or equal to the height of the front wall, a base plate of vessel is of transparent or translucent structure.

5. The electric fireplace flame curtain with adjustable simulated charcoal bed as claimed in claim 1, wherein a bottom of the front wall is protrusive to be L-shaped portion and form a concave groove, inside said concave groove has a trapezoid cross-section.

6. The electric fireplace flame curtain with adjustable simulated charcoal bed as claimed in claim 5, wherein a base plate of the vessel is of transparent structure.

7. The electric fireplace flame curtain with adjustable simulated charcoal bed as claimed in claim 5, wherein the electrical fireplace flame generator is disposed at a bottom portion of the vessel.

8. The electric fireplace flame curtain with adjustable simulated charcoal bed as claimed in claim 1, wherein a chamber is formed at a forward bottom of the vessel, the light-holding charcoals are disposed in the chamber, and a cover with imaging mechanism disposed inside is mounted at the top of the chamber, said chamber is of trapezoid cross-section or rectangular structure.

9. The electric fireplace flame curtain with adjustable simulated charcoal bed as claimed in claim 8, wherein the electrical fireplace flame generator is disposed at a bottom portion of the chamber.

* * * * *